US010736377B1

(12) United States Patent
Fotouhie

(10) Patent No.: US 10,736,377 B1
(45) Date of Patent: Aug. 11, 2020

(54) FAN FORCE VENTILATING SHOES

(71) Applicant: Hadie Fotouhie, Albuquerque, NM (US)

(72) Inventor: Hadie Fotouhie, Albuquerque, NM (US)

( * ) Notice: Subject to any disclaimer, the term of this patent is extended or adjusted under 35 U.S.C. 154(b) by 40 days.

(21) Appl. No.: 15/922,115

(22) Filed: Mar. 15, 2018

Related U.S. Application Data

(60) Provisional application No. 62/606,891, filed on Oct. 13, 2017.

(51) Int. Cl.

| | |
|---|---|
| ***A43B 7/08*** | (2006.01) |
| ***A43B 13/14*** | (2006.01) |
| ***A43B 21/24*** | (2006.01) |
| ***A43B 3/00*** | (2006.01) |

(52) U.S. Cl.
CPC ..... *A43B 7/081* (2013.01); *A43B 3/0005* (2013.01); *A43B 7/082* (2013.01); *A43B 7/085* (2013.01); *A43B 7/087* (2013.01); *A43B 7/088* (2013.01); *A43B 13/14* (2013.01); *A43B 21/24* (2013.01)

(58) Field of Classification Search
CPC ..... A43B 7/081; A43B 7/082; A43B 7/085
See application file for complete search history.

(56) References Cited

U.S. PATENT DOCUMENTS

| | | | | |
|---|---|---|---|---|
| 3,273,264 | A * | 9/1966 | Farinello, Jr. ..... | A43B 3/0005 36/3 A |
| 5,918,381 | A * | 7/1999 | Landry ..... | A43B 1/0054 36/3 B |
| 2005/0235523 | A1* | 10/2005 | Flechsig ..... | A43B 7/081 36/3 R |
| 2010/0005687 | A1* | 1/2010 | Ramadoro (AN) .. | A43B 3/0005 36/3 B |

FOREIGN PATENT DOCUMENTS

| | | | | |
|---|---|---|---|---|
| EP | 1946663 | A1 * | 7/2008 | ..... A43B 7/04 |
| JP | 2007244820 | A * | 9/2007 | |
| JP | 2007300959 | A * | 11/2007 | |

* cited by examiner

*Primary Examiner* — Daniel J Colilla

(57) ABSTRACT

Under normal usage condition, wearing any pair of shoes especially for extended amount of time regardless of the type of shoe, makes feet sweaty and uncomfortable which potentially results in an exhausted foot. By circulating air inside a pair of shoes and around one's feet inside such shoe one can have a more hygienic/healthy and a more pleasant experience throughout the day. Exposure to fresh air not only makes feet more relaxed and comfortable it allows for less odor trapped inside such shoes due to less sweating. I have invented a means of ventilating men's, women's, or kids' shoes to remove heat and objectionable odors normally caused by sweating of one's feet inside a pair of shoes being worn, by means of circulating fresh outside air inside such pair of shoes and around one's feet wearing such shoes.

3 Claims, 6 Drawing Sheets

Side elevation view of a typical invented fan force ventilating shoe

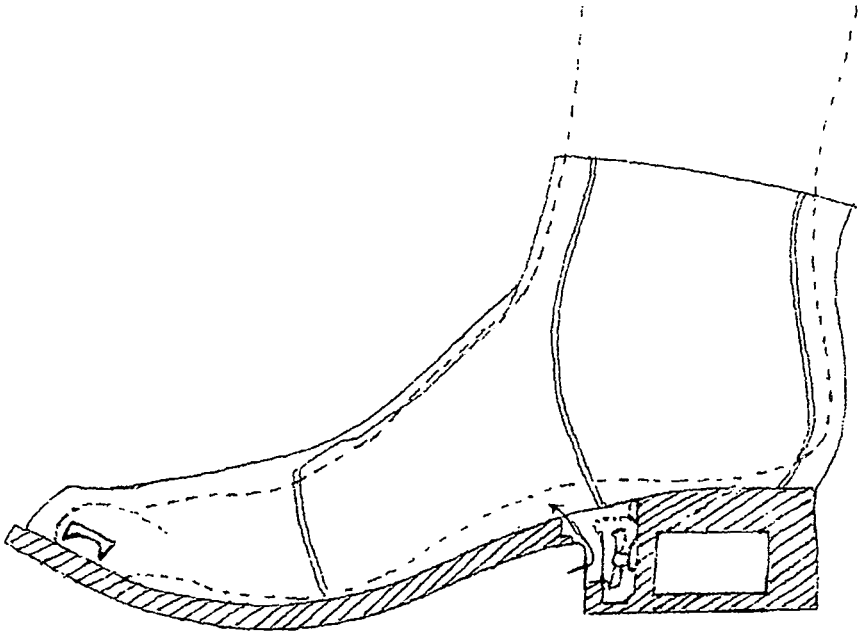
FIG. 1 Side elevation view of a typical invented fan force ventilating shoe

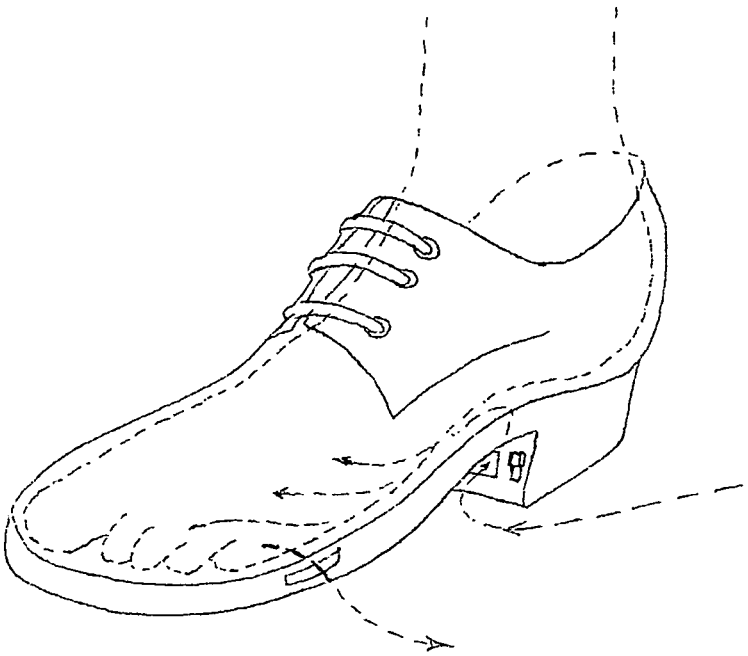
FIG. 2 Perspective view of foot inside the invented shoe, showing airflow pathway

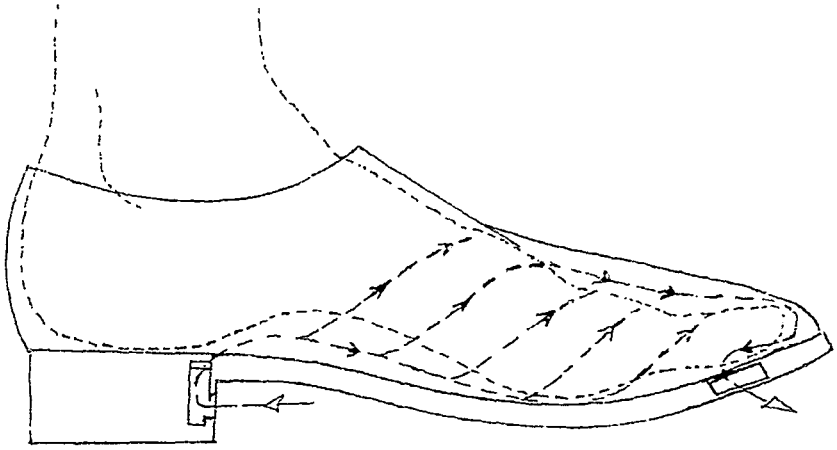
FIG. 3 Side elevation view with typical air pathway showing example of air inlet and a possible exhaust outlet

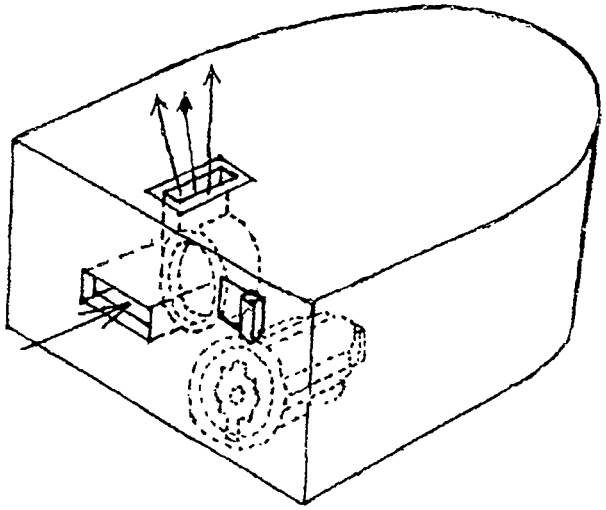
FIG. 4 Typical invented shoe heel, detailed in perspective view

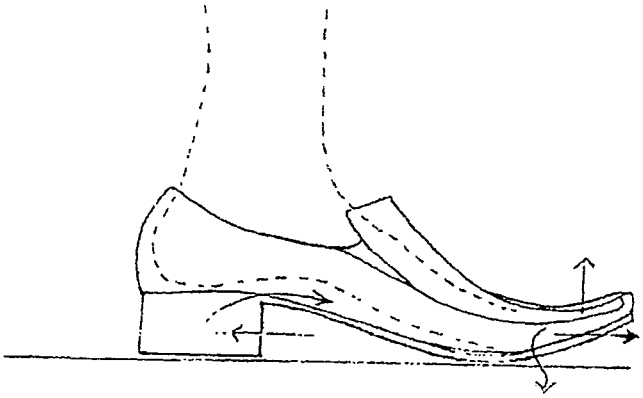
FIG. 5 Side elevation view of a typical loafer type shoe showing the air inlet and 3 possible outlet exhausted air pathways

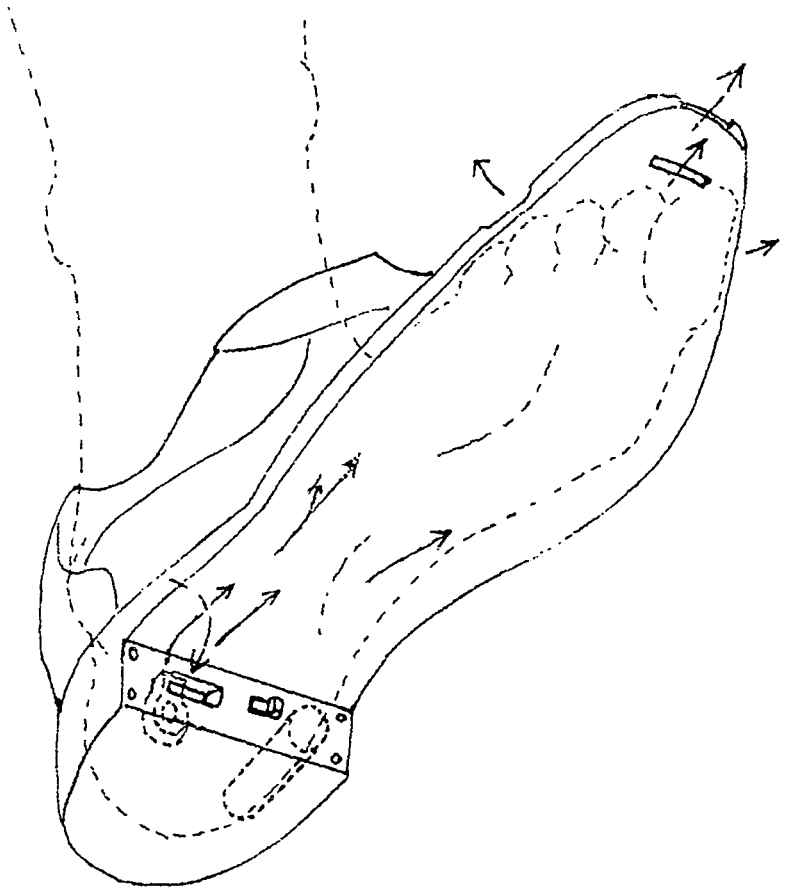
FIG 6 Perspective view of under a typical invented shoe showing inlet and possible outlets, battery/pack compartment, on/off switch, and a typical mini blower fan

FAN FORCE VENTILATING SHOES

BACKGROUND OF THE INVENTION

Wearing any pair of shoes especially over an extended period of time, such as throughout a working or school day, can become an exhaustive and uncomfortable experience as one's foot trapped inside a shoe can get sweaty and deprived of fresh and circulating air. Off course among other consequences is the bad odor generated inside the shoe and emitted from one's foot or socks/stockings since the foot is in contact with a trapped air inside a shoe all the time during usage.

The proposed fan force ventilating shoes is intended for men's, women's, or kids' shoes of various style and fashion, and its goal is to remove heat and objectionable odors resulting from sweating of one's feet inside a pair of shoes being worn and/or for better circulation of air and subsequently feeling generally more comfortable while wearing such pair of shoes. Subsequently the user of such shoes will feel generally more comfortable and will have a more enjoyable experience while wearing such pair of shoes, especially for an extended amount of time. There will be no substantial additional weight felt by the user and the design can still be ergonomic. The user of such pair of shoes at any time can turn off the air flow by turning off the blower on/off switch with no major effort as she/he wishes to keep the feet warmer inside such shoes or to stop airflow. In the proposed Fan Forced Ventilating Shoes described in this application, the focal point is to make wearing shoes whether it is women's, men's or children's shoes and regardless of the type of shoe for example dress shoes, athletic shoes, casual shoes, work shoes, etc., more comfortable and hygienic, which also leads to an elevated level of relaxation of the user's feet. A battery powered/DC mini blower fan unit assembled in the heel of such shoe enables air circulation and subsequent ventilation of the air normally trapped inside. The inlet air then flows into such shoe via openings in the bottom and sole of such shoes and eventually exhausted from openings in various possible regions of such shoe as the drawings section and the detailed description section of this document indicate.

As a result of all the above described arrangements, by ventilating one's foot while inside such pair of shoes thru circulation of outside air, removal of heat which causes sweat and odor from inside of such shoe being worn and exhausting the air to outside becomes feasible.

BRIEF SUMMARY OF THE INVENTION

In this invention, the fan force ventilating shoes unlike regular shoes can be worn for extended period of time without feeling sweated inside the shoes and without causing objectionable odor to the socks/stockings or feet, while the user enjoys a more comfortable and hygienic experience in walking or jogging. Such shoes can be designed and made for adults or kids or any gender and are suitable for walking and/or jogging, sports, work and other uses.

Circulating outside air inside these shoes using a built-in mini fan allows removing not only heat which causes sweat and odor from inside of shoes being worn but further makes wearing such shoes more comfortable and hygienic by replacing otherwise trapped air within such shoes and exhausting objectionable heat and odor to outside atmosphere. Circulation of air around the feet even for a limited time makes feet less exhausted and stressed inside shoes and because the heat is exchanged, better endurance of one's feet wearing such shoes can be realized. Such circulation of outside air is achieved by using a DC-powered mini fan with possible rechargeable batteries mounted in the heel of the shoe. The fan can be turned off by a small switch toggled on or off as needed or be kept on throughout the day. The outside air which comes inside such pair of shoes via openings in the bottom and sole of such shoes flows under and around feet then exits via openings in various parts of the shoe.

The battery powered/DC small blower fan unit assembled in the heel of such shoe enables air circulation and subsequent ventilation of the air normally trapped inside.

BRIEF DESCRIPTION OF THE DRAWINGS

The drawings presented show the invention in side elevation view and perspective view for full understanding of the invention's configurations and for capturing its usefulness. These drawings simply represent the general idea and are not to scale. The presented views are also identified by figure numbers in the claim page of this application.

Please be advised that the solid line features drawn represent the actual invented shoe detail which are visible, and the dashed lines are the hidden lines which are not directly visible. In the attached figures the contour of the user's foot wearing the invented shoe are also in dashed lines. The arrows represent airflow pathways in and out of the shoe and around the foot of the user.

FIG. 1 shows side elevation view of the invention

FIG. 2 shows perspective view of the invention

FIG. 3 shows side elevation view of the invention

FIG. 4 shows perspective view of the heel of the invented shoe

FIG. 5 shows side elevation view of a typical invented shoe

FIG. 6 shows perspective view of underneath of a typical invented shoe

DETAILED DESCRIPTION OF THE INVENTION

Fan force ventilating shoes (for men's, women's, or kids' shoes) removes heat and the resulting objectionable odors resulting due to sweating of one's feet inside a pair of shoes being worn and/or for better circulation of air and subsequently feeling generally more comfortable while wearing such pair of shoes.

This invention is intended primarily for ventilating one's foot while in such shoe by circulating outside air. The air circulation allows for removing heat which causes sweat and odor from inside of shoes being worn. This further makes wearing such shoes more comfortable and hygienic by replacing otherwise trapped air within such shoes and exhausting objectionable heat and odor to the outside atmosphere.

The battery powered/DC mini blower fan unit assembled in the heel of such shoe enables air circulation and subsequent ventilation of the air normally trapped inside. There is an ON/OFF toggle switch/key built next to the inlet of air on shoe heel which can start or turn off the battery-operated/DC mini blower fan unit. The air then flows into such shoe via openings in the bottom and sole of such shoes. The air inlet/opening could be of various configuration including for example rectangular, circular, obround, etc. which also depends on the type of the mini-blower unit in use. Also, the design allows for inlet and outlet closure for example by means of zipper or a sliding piece during cold season if so desired to keep the inside trapped air warm. The outlet of exhaust air can be of any above-referenced geometric configurations mentioned for inlet air opening, and could be in the front end of the shoe, bottom of the shoe or front side(s) of such pair of shoes.

The invention claimed is:

1. A ventilated shoe, comprising:

a heel located under the shoe;

a DC mini blower fan unit located in the heel;

a battery located in the heel configured to power the DC mini blower unit;

a front wall of the heel located under the sole of the shoe;

an air inlet located in the front wall of the shoe;

an ON/OFF switch located in the front wall of the heel configure to start or turn off the DC mini blower fan unit;

an opening in the top of the heel that communicates with an opening in the sole of the shoe;

at least one air outlet located at the toe portion of the shoe;

wherein the DC mini blower fan is configured to draw air through the air inlet in the front wall of the heel and blow it through the opening in the top of the heel and in the sole of the shoe so that air is forced into the underfoot arch cavity of a foot in the shoe, along the length of the foot and is exhausted out through the at least one air outlet located in the top portion of the shoe adjacent a toe portion of the shoe.

2. The ventilated shoe according to claim 1, further comprising a pocketsize/hand held remote control device operated by the user configured to turn the DC mini blower unit on and/or off as desired.

3. The ventilated shoe according to claim 1, wherein the air inlet can be any one of a variety of geometric configurations selected from the group comprised of rectangular, circular, and obround, which also depends on the type of mini-blower in use.

* * * * *